US007627996B2

(12) United States Patent
Honda

(10) Patent No.: US 7,627,996 B2
(45) Date of Patent: Dec. 8, 2009

(54) OPENING PORTION PERIPHERY DECORATIVE MEMBER, OPENING PORTION PERIPHERY CONSTRUCTION STRUCTURE, AND OPENING PORTION PERIPHERY CONSTRUCTION METHOD

(75) Inventor: Takashi Honda, Anjo (JP)

(73) Assignee: Nichiha Co., Ltd, Nagoya-shi (JP)

( * ) Notice: Subject to any disclaimer, the term of this patent is extended or adjusted under 35 U.S.C. 154(b) by 517 days.

(21) Appl. No.: 11/410,304

(22) Filed: Apr. 25, 2006

(65) Prior Publication Data

US 2006/0272238 A1 Dec. 7, 2006

(30) Foreign Application Priority Data

Apr. 27, 2005 (JP) ..... 2005-129829

(51) Int. Cl.
*E06B 1/02* (2006.01)

(52) U.S. Cl. ..... 52/211; 52/204.1; 52/205; 52/204.5; 52/204.53

(58) Field of Classification Search ..... 52/211, 52/74, 204.53, 215, 214, 204.62, 204.55
See application file for complete search history.

(56) References Cited

U.S. PATENT DOCUMENTS 6,889,474 B2 * 5/2005 Wesdock ..... 52/74
6,922,958 B2 * 8/2005 Derderian ..... 52/204.55
6,938,380 B2 * 9/2005 Friedman et al. ..... 52/30
7,114,299 B2 * 10/2006 Ringness ..... 52/204.1
2003/0056450 A1 * 3/2003 Bealko ..... 52/204.55
2004/0200160 A1 * 10/2004 Derderian ..... 52/204.1

FOREIGN PATENT DOCUMENTS

JP 3502832 7/2002

* cited by examiner

*Primary Examiner*—Richard E Chilcot, Jr.
*Assistant Examiner*—Alp Akbasli
(74) *Attorney, Agent, or Firm*—Edwards Angell Palmer & Dodge LLP

(57) ABSTRACT

The present invention provides an opening portion periphery decorative member easy in construction, excellent in external appearance and excellent in weather resistance, an opening portion periphery construction structure, and an opening portion periphery construction method. Accordingly, an opening portion periphery construction structure includes an opening portion periphery decorative member 10 to be installed on a periphery of an opening portion 5 of a building, upper, lower, left and right L-joiners 100 to be installed on upper, lower, left and right sides of the opening portion 5, respectively, and upper, lower, left and right frame members 11 each configured to be engaged with the corresponding L-joiner 100 and fixed to a front face 20 of an underlayment member 2. The L-joiner 100 has a front plate portion 101, an inner side plate portion 102, and a joiner side engaging portion 103.

14 Claims, 10 Drawing Sheets

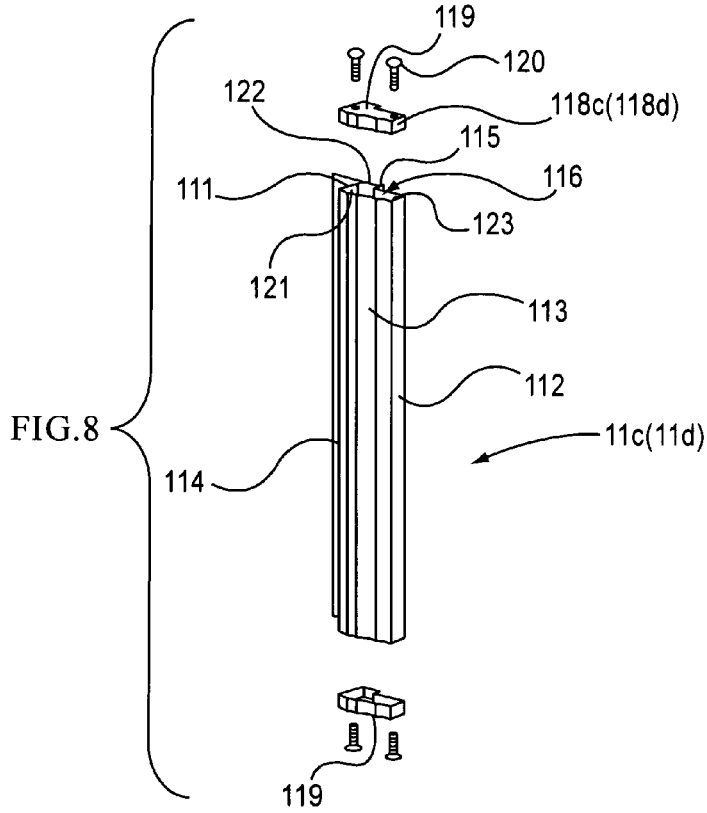
FIG.8
FIG.9
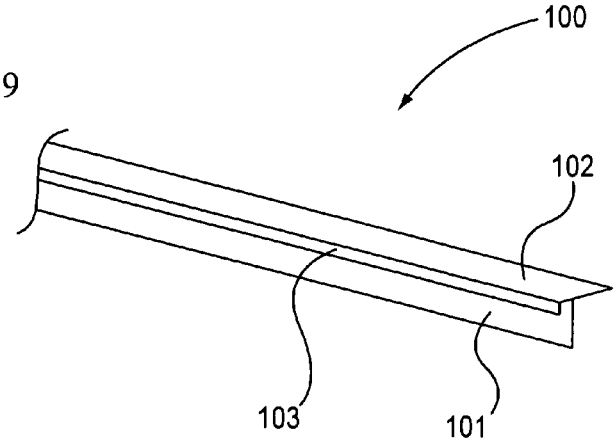

OPENING PORTION PERIPHERY DECORATIVE MEMBER, OPENING PORTION PERIPHERY CONSTRUCTION STRUCTURE, AND OPENING PORTION PERIPHERY CONSTRUCTION METHOD

This application claims priority under 35 U.S.C. §119 to Japanese Patent Application No. 2005-129829 filed on Apr. 27, 2005, the entire disclosure of which is incorporated herein by reference in its entirety.

BACKGROUND OF THE INVENTION

1. Field of the Invention

The present invention relates to an opening portion periphery decorative member to be installed on a periphery of an opening portion of a building, an opening portion periphery construction structure, and an opening portion periphery construction method.

2. Description of the Related Art

The following description sets forth the inventor's knowledge of related art and problems therein and should not be construed as an admission of knowledge in the prior art.

Conventionally, as shown in FIG. 14, an opening portion periphery decorative member 90 to be installed along the four peripheral sides of an existing opening portion, such as, e.g., a window of a building external wall surface and an opening portion periphery construction method for constructing an opening portion periphery construction structure 9 using the aforementioned decorative member 90 for remodeling are proposed (see, e.g., Japanese Patent No. 3,502,832).

As shown in FIG. 14, the aforementioned opening portion periphery decorative member 90 includes four L-joiners 95 to be attached to furring strips 80 installed along four peripheral sides of an opening portion, four straight members 91 to be installed on straight portions of the opening portion at the front face of the L-joiners 95, four corner members 92 to be installed on corner portions of the opening portion, and eight connecting members 94 (these connecting members can be omitted) each for connecting the straight member 91 and the corner member 92.

The aforementioned opening portion periphery construction structure 9, however, are expensive, and that it takes a long time to undertake the construction because of a large number of parts constituting the opening portion periphery decorative member 90. In addition, since the straight member 91 and the corner member 92 each have a dented groove 93 for accommodating the end portion 810 of the remodeling external wall panel 81, the width of the dented groove 93 and the thickness of the external wall panel 81 to be newly installed should be approximately the same. This causes limitation of the thickness of the external wall panel 81 which can be used.

Moreover, a clearance is formed between the opening portion periphery decorative member 90 and the L-joiner 95, which may cause rain water intrusion and make it difficult to obtain an opening portion periphery construction structure 9 excellent in external appearance.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some embodiments can provide an opening portion periphery decorative member easy in construction and excellent in external appearance and weather resistance.

Among other potential advantages, some embodiments can provide an opening portion periphery construction structure easy in construction and excellent in external appearance and weather resistance.

Among other potential advantages, some embodiments can provide an opening portion periphery construction method capable of easily executing the construction.

According to a first aspect of some preferred embodiments of the present invention, an opening portion periphery decorative member to be installed on a periphery of an opening portion of a building, the decorative member comprising:

upper, lower, left and right L-joiners each to be fixed to an underlayment member installed as an underlayment of an external wall panel along upper, lower, left and right sides of the opening portion; and upper, lower, left and right frame members each configured to be engaged with the upper, lower, left and right L-joiners, respectively, and fixed to a front face of the underlayment member, wherein the L-joiners each have a front plate portion to be fixed to a front face of the underlayment member, an inner side plate portion extended rearward from one end of the front plate portion so as to be placed on an inner side surface of the underlayment member, and a joiner side engaging portion protruded frontward from the one end of the front plate portion, and wherein the frame members each have an outward face portion to be disposed so as to face to an end portion of the external wall panel, an inward face portion to be disposed so as to face to the opening portion, a decorative portion which decorates the periphery of the opening portion and connects a front end of the outward face portion and a front end of the inward face portion, a frame side engaging portion configured to be engaged with the joiner side engaging portion at a rear end portion of the inward face portion, and a fixing plate portion extended from a rear end of the outward face portion in a direction away from the frame side engaging portion and configured to be fixed to the underlayment member.

The aforementioned opening portion periphery decorative member is mainly constituted by the L-joiners and the frame members. Therefore, the number of parts constituting the opening portion periphery decorative member can be reduced, which in turn can easily construct the opening portion periphery construction structure using the opening portion periphery decorative member at low cost.

Furthermore, since the aforementioned L-joiner has the front plate portion and the inner side plate portion, the front plate portion can be fixed to the front face of the underlayment member and the inner side plate portion can be placed on the inner side surface of the underlayment member. This enables concealing of the underlayment member installed as an underlayment of an external wall panel, which in turn can obtain an opening portion periphery construction structure excellent in external appearance by using the opening portion periphery decorative member.

The L-joiner has the joiner side engaging portion, and the frame member has the frame side engaging portion and the fixing plate portion. Thus, the frame side engaging portion can be engaged with the joiner side engaging portion and the fixing plate portion can be fixed to the underlayment member, resulting in stable fixing of the frame member to the underlayment member. That is, the frame member can be fixed to the underlayment member at two portions in the width direction thereof. This prevents frontward lifting of the portion of the frame member located at the opposite side of the fixing plate portion, which prevents generation of a clearance at the opening portion side between the frame member and the L-joiner. As a result, an opening portion periphery construction structure excellent in external appearance and weather resistance can be obtained.

Moreover, the frame member has the outward face portion to be disposed so as to face to the end portion of the external wall panel. The end portion of the external wall panel is installed so as to face to the outward face portion. Therefore, since it is not necessary, for example, to engage the end portion of the external wall panel with the frame member, even if there are construction errors, the opening portion periphery construction structure can be constructed easily and assuredly. Moreover, the external wall panel used for the opening portion periphery construction structure is not required to have a specific thickness.

According to the first aspect of some preferred embodiments of the present invention, it is possible to provide an opening portion periphery decorative member capable of constructing an opening portion periphery construction structure excellent in external appearance and weather resistance.

According to a second aspect of some preferred embodiments of the present invention, an opening portion periphery construction structure in which an opening portion periphery decorative member is installed on a periphery of an opening portion of a building, the structure comprising:

an underlayment member installed as an underlayment of an external wall panel along upper, lower, left and right sides of the opening portion;

the opening portion periphery decorative member attached to the underlayment member; and the external wall panel having an end portion placed outside the opening portion periphery decorative member so that the end portion faces to the opening portion periphery decorative member, wherein the opening portion periphery decorative member has upper, lower, left and right L-joiners each to be fixed to the underlayment member, upper, lower, left and right frame members each to be fixed to a front face of the underlayment member and configured to be engaged with the corresponding L-joiner, wherein the L-joiners each have a front plate portion, an inner side plate portion extended rearward from one end of the front plate portion, and a joiner side engaging portion protruded frontward from the one end of the front plate portion, wherein the frame members each have an outward face portion, an inward face portion, a decorative portion which connects a front end of the outward face portion and a front end of the inward face portion, a frame side engaging portion formed at a rear end portion of the inward face portion, and a fixing plate portion extended from a rear end of the outward face portion in a direction away from the frame side engaging portion, wherein the front plate portion of the L-joiner is fixed to a front face of the underlayment member, and the inner side plate portion of the L-joiner is placed on an inner side surface of the underlayment member, and wherein the decorative portion is disposed so as to decorate the opening portion in a state in which the frame side engaging portion of the frame member is engaged with the joiner side engaging portion, the fixing plate portion is fixed to the underlayment member, and the outward face portion is faced to the end portion of external wall panel.

The opening portion periphery decorative member is mainly constituted by the L-joiner and the frame member. Therefore, the number of parts constituting the opening portion periphery decorative member can be reduced, which in turn can easily construct the opening portion periphery construction structure at low cost.

Furthermore, the L-joiner is installed such that the front plate portion is fixed to the front face of the underlayment member and the inner side plate portion is placed on the inner side surface of the underlayment member. This enables concealing of the underlayment member installed as an underlayment of an external wall plate, which in turn can obtain an opening portion periphery construction structure excellent in external appearance.

Furthermore, since the frame member is fixed to the underlayment member in a state in which the frame side engaging portion is engaged with the joiner side engaging portion and the fixing plate portion is in contact with the underlayment member, the frame member can be stably fixed to the underlayment member. That is, in fixing the frame member to the underlayment member, the fixing plate portion is fixed with nails in a state in which the frame member is engaged with the L-joiner, which prevents generation of a clearance at the opening portion side between the frame member and the L-joiner. As a result, an opening portion periphery construction structure excellent in external appearance and weather resistance can be obtained.

Furthermore, the frame member has the outward face portion facing the end portion of the external wall panel. The end portion of the external wall panel is installed so as to face to the outward face portion. Therefore, since it is not necessary, for example, to engage the end portion of the external wall panel with the frame member, the opening portion periphery construction structure can be constructed easily and assuredly. Moreover, the external wall panel used for the opening portion periphery construction structure is not required to have a specific thickness.

According to the second aspect of some preferred embodiments of the present invention, as will be understood from the above, it is possible to provide an opening portion periphery construction structure capable of constructing an opening portion periphery construction structure excellent in external appearance and weather resistance.

According to a third aspect of some preferred embodiments of the present invention, a method of constructing an opening portion periphery by disposing an opening portion periphery decorative member around an opening portion of a building, wherein the opening portion periphery decorative member includes four L-joiners each provided with a front plate portion, an inner side plate portion extended rearward from one end of the front plate portion, and a joiner side engaging portion protruded frontward from the one end of the front plate portion, and four frame members each provided with an outward face portion, an inward face portion, a decorative portion which connects a front end of the outward face portion and a front end of the inward face portion, a frame side engaging portion formed at a rear end portion of the inward face portion, and a fixing plate portion extended from a rear end of the outward face portion in a direction away from the frame side engaging portion, wherein, in constructing the opening portion periphery, the steps are executed, the steps including an L-joiner fixing step of fixing the L-joiners to an underlayment member installed as an underlayment of an external wall panel along upper, lower, left and right sides of the opening portion, a frame member attaching step of attaching the frame members to the underlayment member by engaging the frame members with the L-joiners, an external wall panel attaching step of attaching an external wall panel in a state in which an end portion of the external wall panel faces to the frame members, and a sealing material casting step for casting sealing material between the end portion of the external wall panel and the frame member, wherein, in the L-joiner fixing step, the L-joiner is disposed such that the front plate portion is fixed to a front face of the underlayment member and the inner side plate portion is placed on an inner side surface of the underlayment member, wherein, in the frame member attaching step, the frame member is disposed so as to decorate the opening portion periphery by the decorative portion in a state in which the frame side engaging portion is engaged with the joiner side engaging portion and the fixing plate portion is fixed to the underlayment member, and wherein, in the external wall panel attaching step, the end portion of the external wall panel is disposed so as to face to the outward face portion of the frame member.

The opening portion periphery decorative member used in the opening portion periphery construction method is mainly constituted by the L-joiners and the frame members. Therefore, the number of parts constituting the opening portion periphery decorative member can be reduced, which in turn can simplify the L-joiner fixing step and the frame member attaching step. Thus, the opening portion periphery construction structure can be easily formed at low cost.

In the L-joiner fixing step, the L-joiner is installed such that the front plate portion is fixed to the front face of the underlayment member and the inner side plate portion is placed on the inner side surface of the underlayment member. This enables concealing of the underlayment member installed as a underlayment of an external wall plate, which in turn can obtain an opening portion periphery construction structure excellent in external appearance.

In the frame member attaching step, the frame side engaging portion is engaged with the joiner side engaging portion and the fixing plate portion is fixed to the underlayment member. This enables stable fixing of the frame member to the underlayment member. That is, the frame member can be fixed to the underlayment member at two portions in the width direction. This prevents a frontward lifting of the portion of the frame member located at the opposite side of the fixing plate portion, which prevents generation of a clearance at the opening portion side between the frame member and the L-joiner. As a result, an opening portion periphery construction structure excellent in external appearance and weather resistance can be obtained.

Furthermore, in the external wall panel attaching step, the end portion of the external wall panel is installed so as to face to the outward face portion. Therefore, since it is not necessary, for example, to engage the end portion of the external wall panel with the frame member, even if there are construction errors, the opening portion periphery construction structure can be formed easily and assuredly. Moreover, the external wall panel used for the opening portion periphery construction structure is not required to have a specific thickness.

In the sealing material casting step, sealing material is cast between the end portion of the external wall panel and the frame member, resulting in an opening portion periphery construction structure excellent in waterproof. Furthermore, even in cases where the external wall panel is cut at a construction site, since the end portion of the external wall panel, which is a cut surface, will not be exposed to the outside, problems, such as, e.g., corrosion, would not occur. Therefore, an opening portion periphery construction structure excellent in weather resistance can be obtained.

According to the third aspect of some preferred embodiments of the present invention, as will be understood from the above, it is possible to provide an opening portion periphery construction method capable of constructing an opening portion periphery construction structure easy in construction and excellent in external appearance and weather resistance.

In the first, second and third aspects of the preferred embodiments of the present invention, the opening portion periphery decorative member, the opening portion periphery construction structure, and the opening portion periphery construction method for constructing the structure can be applied to both new building and remodeling. As the external wall panel, for example, an external wall panel made of ceramic series material can be used. Moreover, the underlayment member can be a wooden or light gauge steel furring strip.

In the present invention, the outward direction of a building and the inward direction of the building are defined as a frontward direction and a rearward direction, respectively. Furthermore, as to each member, such as, e.g., the opening portion periphery decorative member, the upward direction, the downward direction, the rightward direction, and the leftward direction in a state in which each member is installed on the opening portion periphery are defined as the upper direction, the lower direction, the right direction, and the left direction, respectively.

In the aforementioned first and second aspect of the preferred embodiments of the present invention, it is preferable that the frame members each have a hollow portion extending in a longitudinal direction thereof, and the decorative portion, the inward face portion and the outward face portion form a part of the hollow portion. In this case, the frame member excellent in decorativeness can be obtained and weight saving can be attained, which enables to easily obtain the frame member excellent in external appearance at low cost.

In the aforementioned first and second aspect of the preferred embodiments of the present invention, it is preferable that the frame members each are provided with cap members for closing both ends of the hollow portion. In this case, since the end portions of the hollow portion can be assuredly closed by attaching the cap members, it becomes possible to prevent water, such as rain water, from entering into the hollow portion. Furthermore, even if the end portion of the frame member is cut, the cut surface of the frame member can be concealed by covering it. Therefore, an opening portion periphery decorative member and an opening portion periphery construction structure excellent in external appearance and weather resistance can be obtained.

In the aforementioned first and second aspect of the preferred embodiments of the present invention, it is preferable that the frame members each include an upper side frame member and a lower side frame member to be disposed at an upper side of the opening portion and a lower side thereof, respectively, the inward face portion of the upper side frame member and the inward face portion of the lower side frame member each are inclined outwardly toward a front side, the inward face portion of the upper side frame member and the inward face portion of the lower side frame member have the same inclination angle, and an external end surface of the cap member is inclined along the inward face portion. In this case, falling raindrops on the inward face portion of the lower side frame member can be discharged frontward, which prevents accumulation of rain water thereon. Moreover, the inward face portion of the upper side frame member and the inward face portion of the lower side frame member have the same inclination angle. Therefore, in cases where cap members to be attached to the upper and lower ends of the frame member to be installed on the left and right sides of the opening portion are brought into contact with the inward face portions of the upper and lower side frame members, a cap member of the same configuration can be used by disposing it upside down. Accordingly, the number of types of parts constituting the opening portion periphery decorative member can be reduced, which in turn can obtain an easy-to-construct opening portion periphery construction structure at low cost.

In the aforementioned first and second aspect of the preferred embodiments of the present invention, it is preferable that the frame members each include an upper side frame member and a lower side frame member to be disposed at an upper side of the opening portion and a lower side thereof, respectively, and the upper side frame member and the lower side frame member each have a protruded plate portion protruded from a lower end of the decorative portion. In this case, the protruded plate portion can function as water drainage, resulting in enhanced drainage.

In the aforementioned first and second aspect of the preferred embodiments of the present invention, it is preferable that the frame member is an aluminum extruded molded article. In this case, since an aluminum extruded molded article excellent in formability is used, an opening portion periphery decorative member and an opening portion periphery construction structure excellent in decorativeness can be obtained.

In the aforementioned first and second aspect of the preferred embodiments of the present invention, it is preferable that a gap portion is formed between the front plate portion of the L-joiner and the frame member in a state in which the L-joiner and the frame member are combined. In this case, it is possible to prevent frontward lifting of the frame member. That is, in fixing the L-joiner, the front plate portion is fixed to the front face of the underlayment member with screws, nails, etc. At this time, heads of screws or nails can be placed in the gap portion. This prevents the frame member from being lifted frontward by the thickness of the head of the screw or nail due to the existing of the head interfering with the frame member.

In the aforementioned first and second aspect of the preferred embodiments of the present invention, it is preferable that the opening portion periphery construction structure is for reforming, and the underlayment member is fixed to a front face of an existing wall. In this case, the construction can be performed easily, and it is possible to obtain an opening portion periphery construction structure excellent in external appearance for remodeling at low cost.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which:

FIG. 8 is an explanatory perspective view showing a left side (right side) frame member according to the embodiment of the present invention;

FIG. 9 is an explanatory perspective view showing an L-joiner according to the embodiment of the present invention;

DETAILED DESCRIPTION OF THE PREFERRED EMBODIMENTS

In the following paragraphs, some preferred embodiments of the invention will be described with reference to the attached drawings by way of example and not limitation. It should be understood based on this disclosure that various other modifications can be made by those in the art based on these illustrated embodiments.

An opening portion periphery decorative member 10, an opening portion periphery construction structure 1, and an opening portion periphery construction method according to a preferred embodiment of the present invention will be explained with reference to FIGS. 1 to 13.

Figure 1:
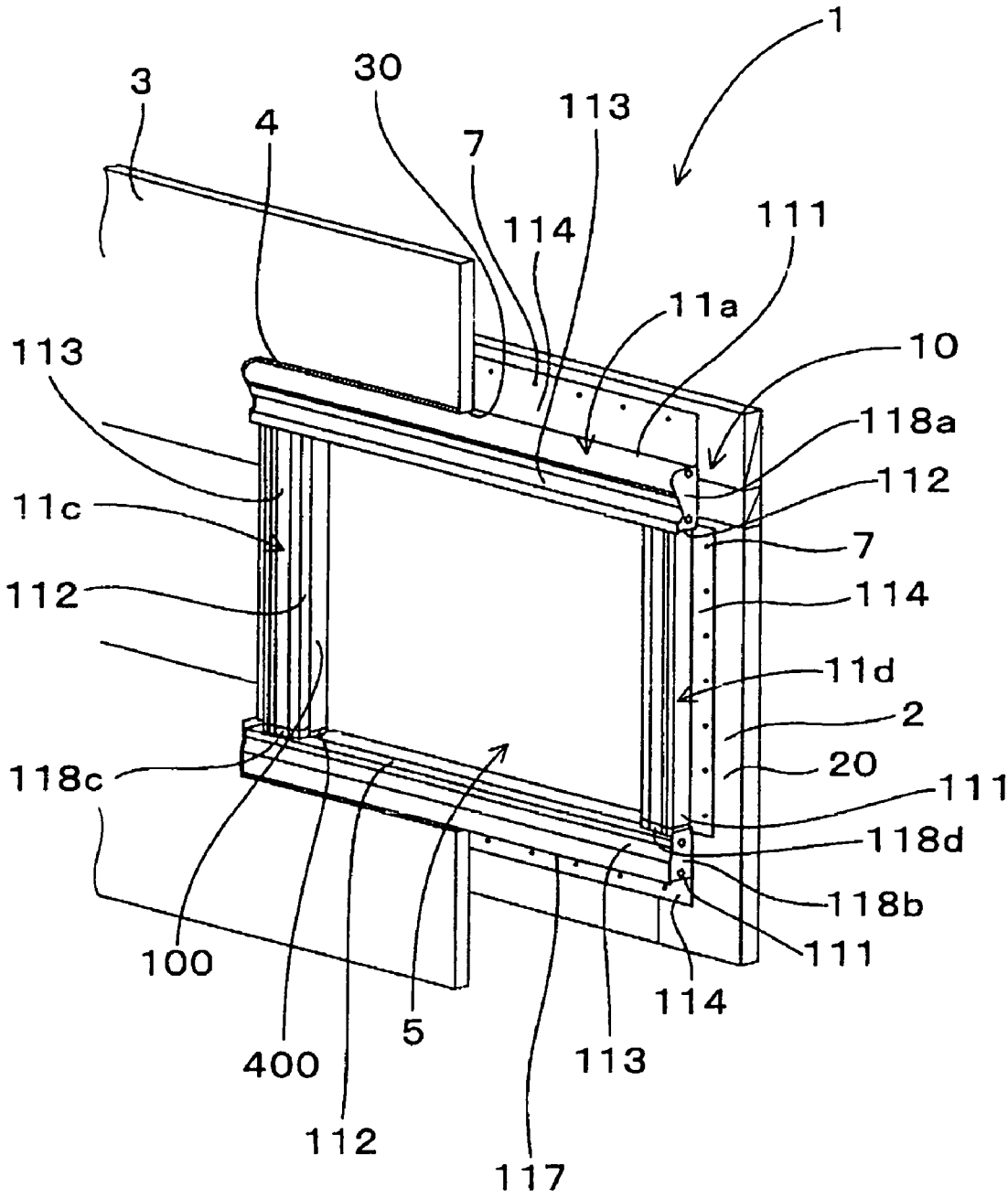
FIG. 1 is an explanatory perspective view showing an opening portion periphery construction structure according to an embodiment of the present invention.
Figure 10:
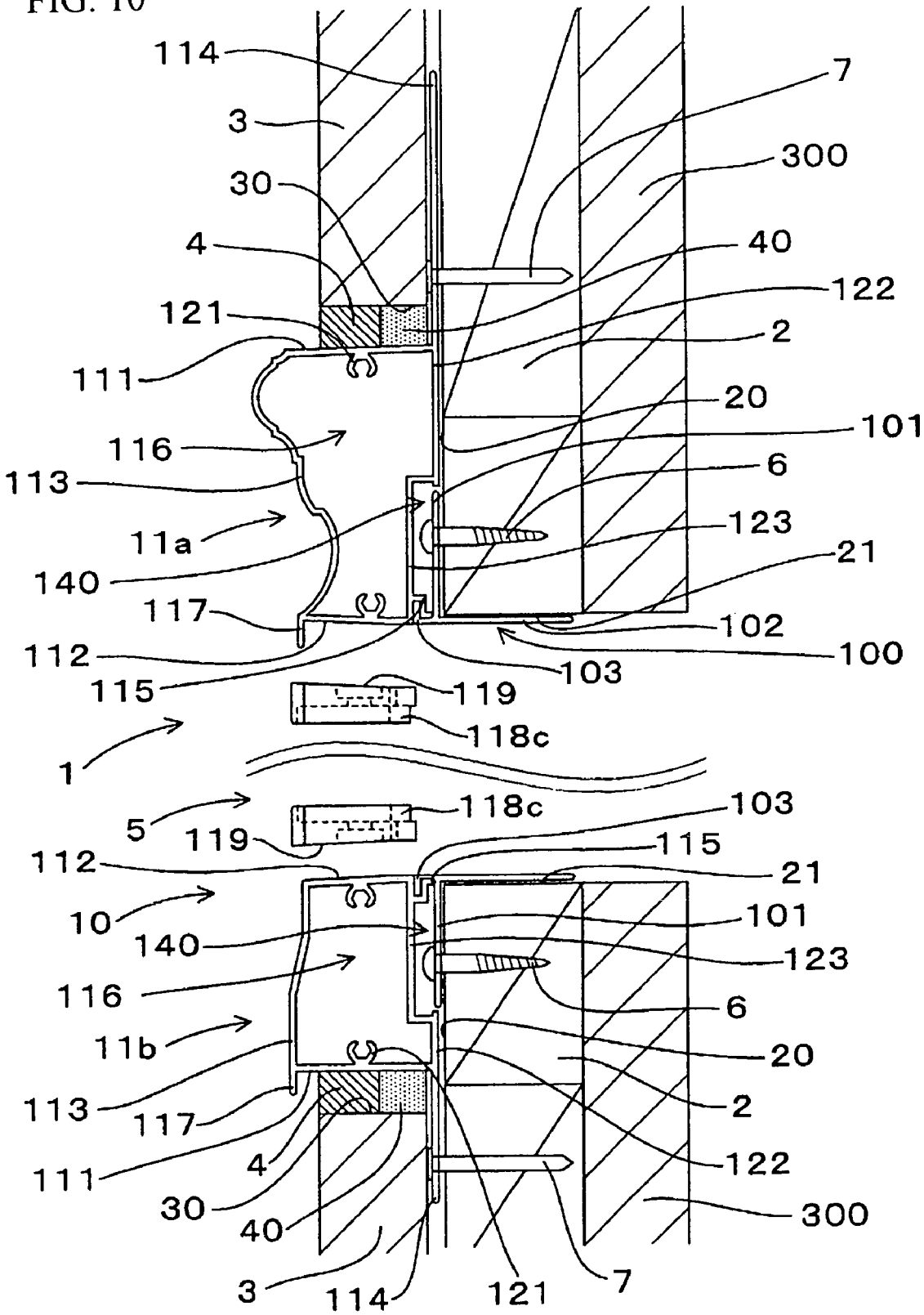
FIG. 10 is a vertical cross-sectional explanatory view showing an opening portion periphery construction structure according to the embodiment of the present invention.
Figure 11:
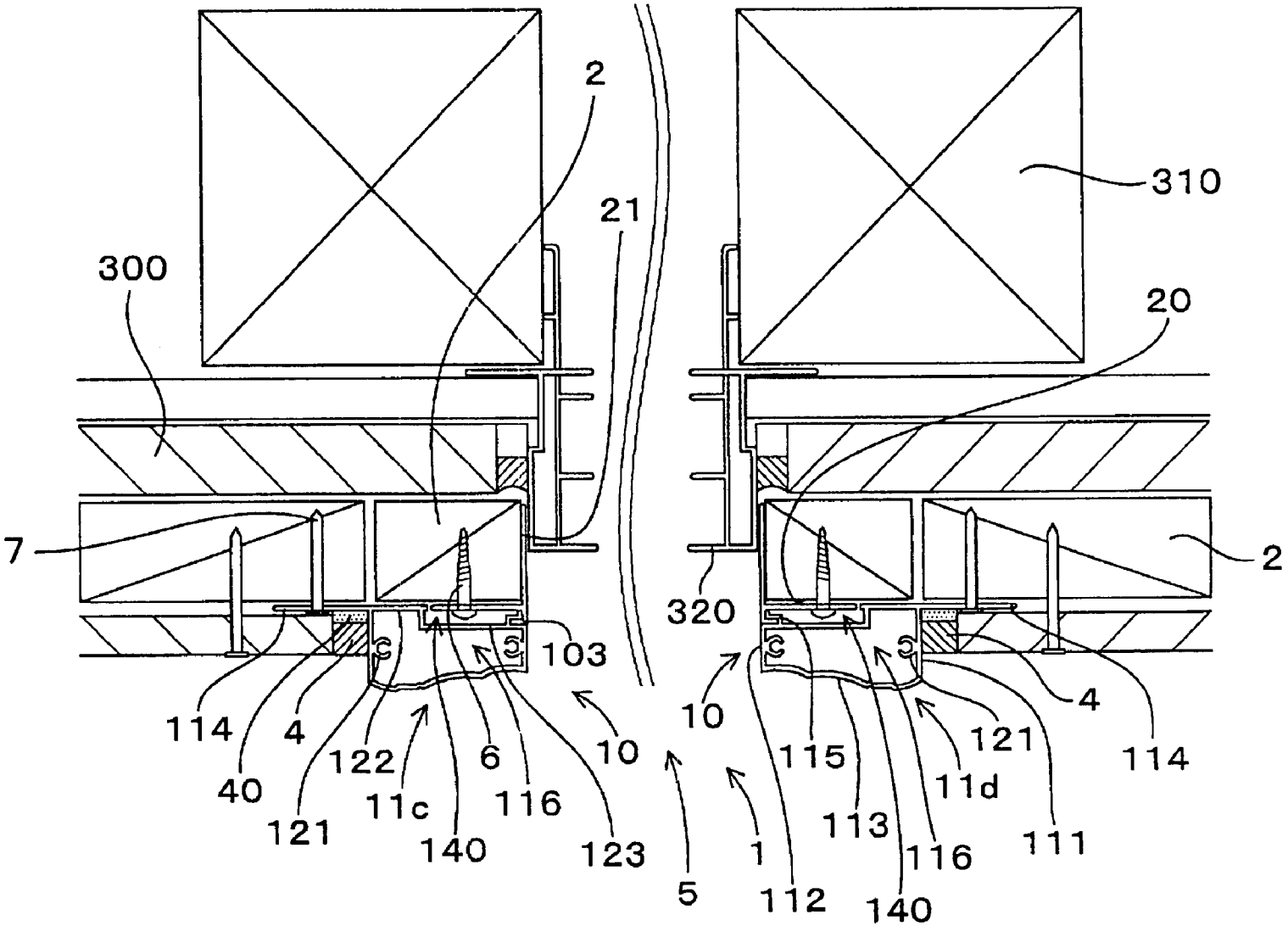
FIG. 11 is a cross-sectional explanatory view showing the opening portion periphery construction structure according to the embodiment of the present invention.

In the opening portion periphery construction structure 1 of this embodiment, as shown in FIGS. 1, 10, 11, an opening portion periphery decorative member 10 is disposed along the periphery of an opening portion 5 of a building external wall surface. The structure 1 includes an underlayment member 2, such as a furring strip, installed as an underlayment of an external wall panel 3 along four sides, i.e., upper, lower, left and right sides, of the opening portion 5, the opening portion periphery decorative member 10 attached to the underlayment member 2, and the external wall panel 3 having an end portion 30 disposed so as to face to an outside of the opening portion periphery decorative member 10.

The opening portion periphery decorative member 10 has upper, lower, left and right L-joiners 100 to be fixed to the underlayment member 2, and upper, lower, left and right frame members 11 each to be engaged with the corresponding L-joiner 100 and fixed to a front face 20 of the underlayment member 2. The frame member 11 includes an upper side frame member 11*a* to be installed on the upper side of the periphery of the opening portion 5, a lower side frame member 11*b* to be installed on the lower side thereof, a left side frame member 11*c* to be installed on the left side thereof, and a right side frame members 11*d* to be installed on the right side thereof. In the following explanation, when simply referred to as a "frame member 11," it refers to all of the four frame members.

As shown in FIGS. 9 to 12, the L-joiner 100 includes a front plate portion 101, an inner side plate portion 102 extended rearward from one end of the front plate portion 101, and a joiner side engaging portion 103 protruded frontward from the one end of the front plate portion 101. Moreover, as shown in FIGS. 2, 10 to 12, the L-joiner 100 is disposed such that the front plate portion 101 is fixed to the front face 20 of the underlayment member 2 and the inner side plate portion 102 is placed on the inner side surface 21 of the underlayment member 2.

As shown in FIGS. 1, 3 to 8, the frame member 11 includes an outward face portion 111 to which the end portion 30 of the external wall panel 3 is faced, an inward face portion 112 to be faced to the opening portion 5, a decorative portion 113 which connects the front end of the outward face portion 111 and the front end of the inward face portion 112 and decorates the periphery of the opening portion 5, a frame side engaging portion 115 formed at the rear end portion of the inward face portion 112, and a fixing plate portion 114 extended from the rear end of the outward face portion 111 in a direction away from the frame side engaging portion 115.

As shown in FIGS. 10 and 11, the frame member 11 is installed in a state in which the frame side engaging portion 115 is engaged with the joiner side engaging portion 103, the fixing plate portion 114 is fixed to the underlayment member 2, the outward face portion 111 faces to the end portion 30 of the external wall panel 3, and the decorative portion 113 decorates the periphery of the opening portion 5.

Figure 3:
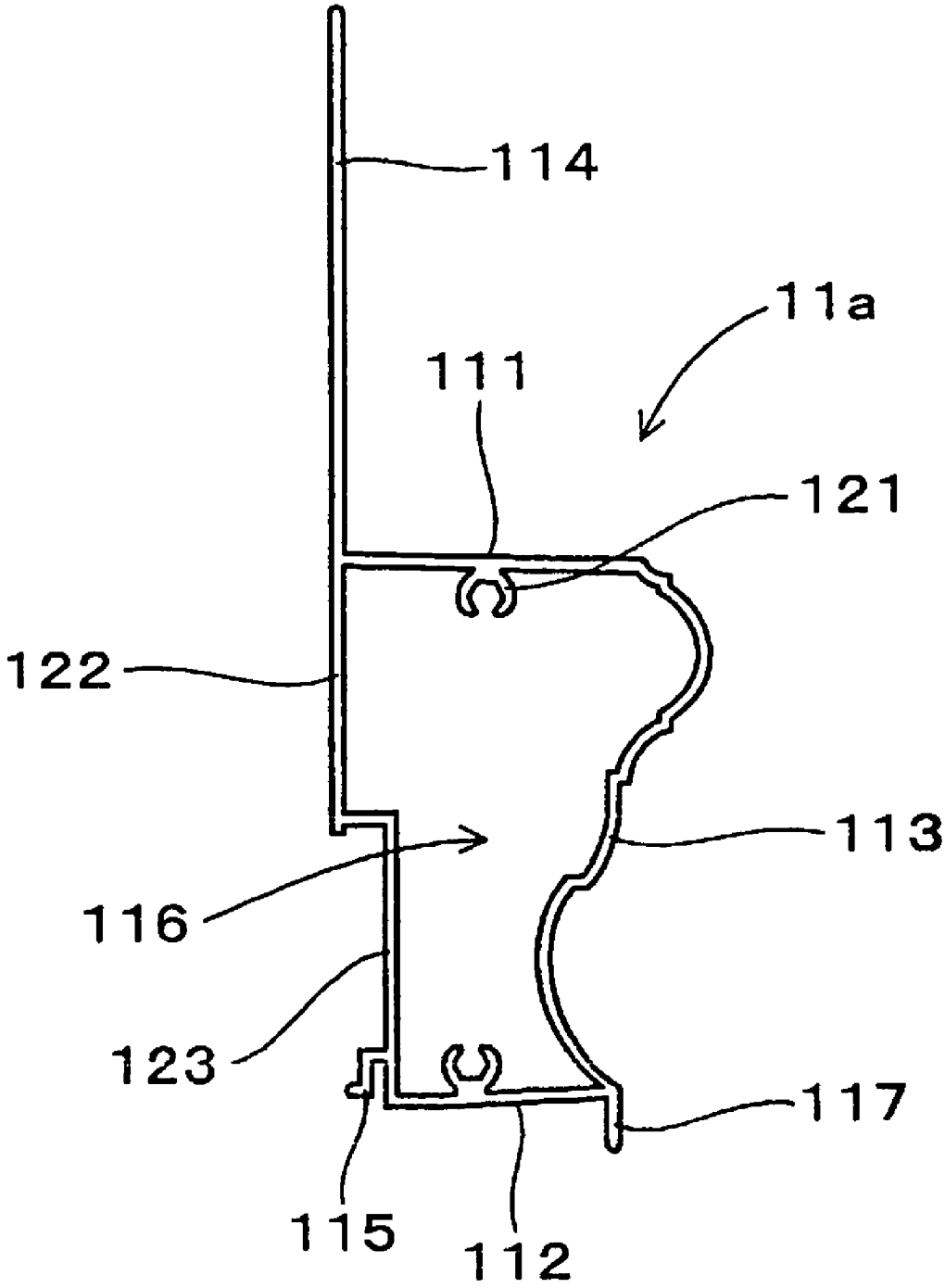
FIG. 3 is an explanatory cross-sectional view showing an upper side frame member according to the embodiment of the present invention.
Figure 4:
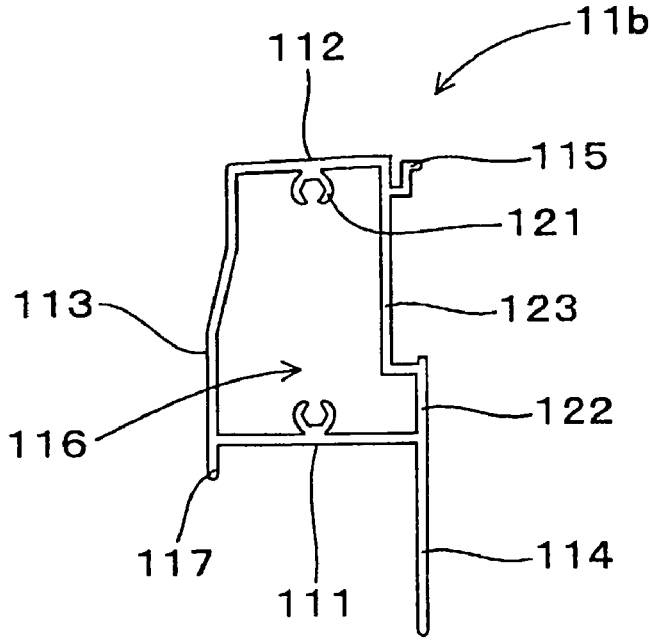
FIG. 4 is an explanatory cross-sectional view showing a lower side frame member according to the embodiment of the present invention.
Figure 5:
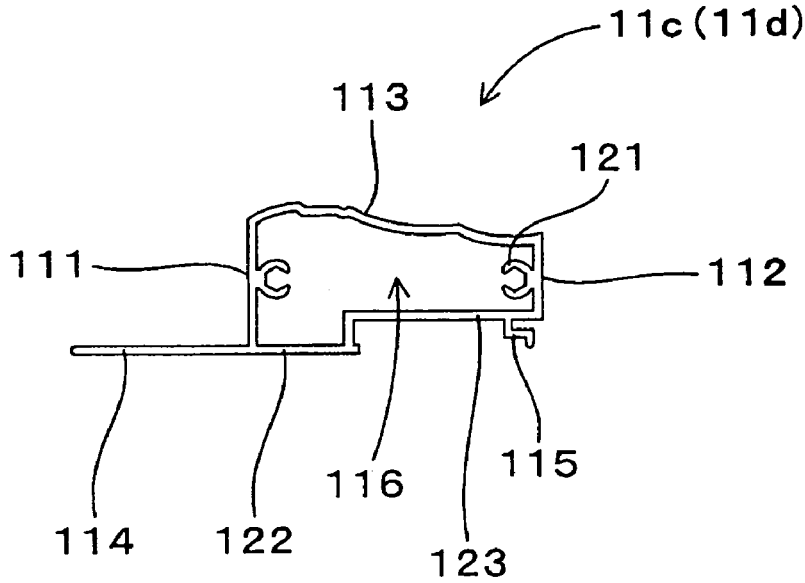
FIG. 5 is an explanatory cross-sectional view showing a left (right) side frame member according to the embodiment of the present invention.

As shown in FIGS. 9 to 11, the joiner side engaging portion 103 is protruded forwardly from the front end of the inner side plate portion 102 and bent in a shape of a hook in the same direction as the extending direction of the front plate portion 101. On the other hand, as shown in FIGS. 3 to 5, the frame side engaging portion 115 is protruded rearward at the rear end portion of the inward face portion 112 and bent in a shape of a hook in a direction opposite to the extending direction of the fixing plate portion 114. Moreover, as shown in FIGS. 6 and 7, the upper side frame member 11*a* and the lower side frame member 11*b* each have a protruded plate portion 117 projected downward from the lower end of the decorative portion 113.

As shown in FIGS. 3 to 8, 10, and 11, the opening portion periphery decorative member 10 has a hollow portion 116 extending in the longitudinal direction thereof, and the decorative portion 113 and the outward face portion 111 form a part of the hollow portion 116. That is, in addition to the outward face portion 111, the inward face portion 112, the decorative portion 113, and the fixing plate portion 114, the opening portion periphery decorative member 10 has a back face plate portion 122 formed on the same plane as the fixing plate portion 114, and a rear plate portion 123 formed frontward with respect to the back face plate portion 122 and connecting the inward face portion 112 and the back face plate portion 122. And the hollow portion 116 is formed as a space surrounded by the decorative portion 113, the outward face portion 111, the inward face portion 112, the back face plate portion 122, and the rear plate portion 123.

As shown in FIGS. 3 to 5, the rear plate portion 123 extends from the rear end of the inward face portion 112 toward the outward face portion 111 and then bent toward the back face plate portion 122. The back face plate portion 122 connects the rear end of the outward face portion 111 and the rear end of the rear plate portion 123. Furthermore, as shown in FIGS. 10 and 11, in the state in which the opening portion periphery decorative member 10 is installed, it is configured such that a gap portion 140 is formed between the front plate portion 101 of the L-joiner 100 and the frame member 11. That is, by forming the rear plate portion 123 located between the frame side engaging portion 115 and the fixing plate portion 114 forward with respect to the rear end of the fixing plate portion 114 and the rear end of the frame side engaging portion 115, the gap portion 140 is formed.

Figure 6:
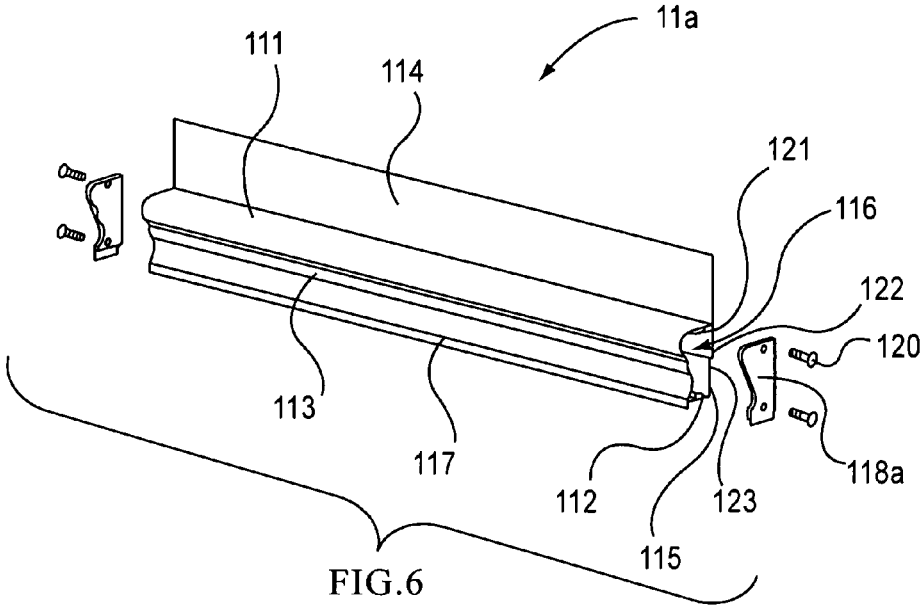
FIG. 6 is an explanatory perspective view showing an upper side frame member according to the embodiment of the present invention.
Figure 7:
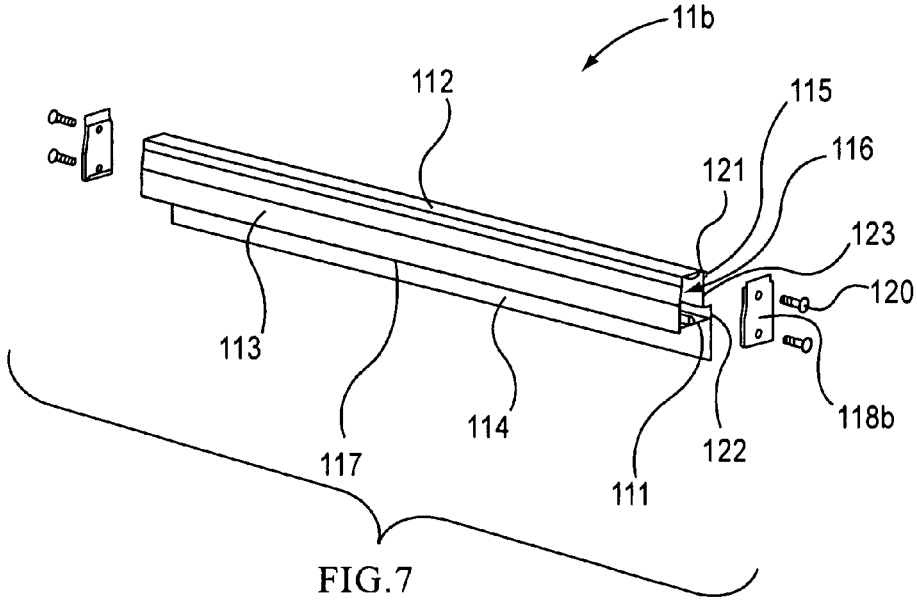
FIG. 7 is an explanatory perspective view showing a lower side frame member according to the embodiment of the present invention.

As shown in FIGS. 1, 6 to 8, in the frame member 11, cap members 118 are attached to both ends of the hollow portion 116 with cap screws 120. That is, the cap screw 120 is screwed into the threaded portion 121 formed in the hollow portion 116 of the frame member 11 with the cap screw 120 inserted into the hole formed in the cap member 118. Thus, the cap members 118 are attached to both ends of the frame member 11. As shown in FIGS. 6 to 8, the threaded portion 121 is formed into an approximately cylindrical shape extending in the longitudinal direction at the inner side of the outward face portion 111 and the inner side of the inward face portion 112 so as to face to the inside of the hollow portion 116.

Furthermore, as shown in FIGS. 1 and 10, the upper, lower, left and right frame members 11*a,b,c* and *d* are placed in a state in which the cap members 118*c* and 118*d* attached to both ends of the left side frame member 11*c* and the right side frame member 11*d* are in contact with the inward face portions 112 of the upper side frame member 11*a* and the lower side frame member 11*b*.

Furthermore, as shown in FIG. 10, in the upper side frame member 11*a* and the lower side frame member 11*b* to be installed on the upper side of the opening portion 5 and the lower side thereof, respectively, among the frame members 11*a,b,c* and *d*, each inward face portion 112 is inclined outward toward the front side. The inward face portion 112 of the upper side frame member 11*a* and the inward face portion 112 of the lower side frame member 11*b* have the same inclination angle, and the external end surface 119 of the cap members 118*c* and 118*d* of the left side frame member 11*c* and the right side frame member 11*d* are inclined so as to fit to the inclination of the inward face portion 112. That is, the external end surfaces 119 and 119 of the cap members 118*c* and 118*d* of the left side and right side frame members 11*c* and 11*d* are in face-contact with the inward face portions 112 and 112 of the upper side and lower side frame members 11*a* and 11*b*.

The frame member 11 and the L-joiner 100 each are an aluminum extruded molded article. The external wall panel 3 is made of ceramic series building materials. The opening portion periphery construction structure 1 is for remodeling, and the underlayment member 2 is fixed to the front face of an existing wall 300 as shown in FIGS. 10 and 11. That is, on the front face of the existing wall 300 around the opening portion 5 formed in the existing wall 300, vertical furring strips and horizontal furring strips are fixed as underlayment members 2.

Figure 12:
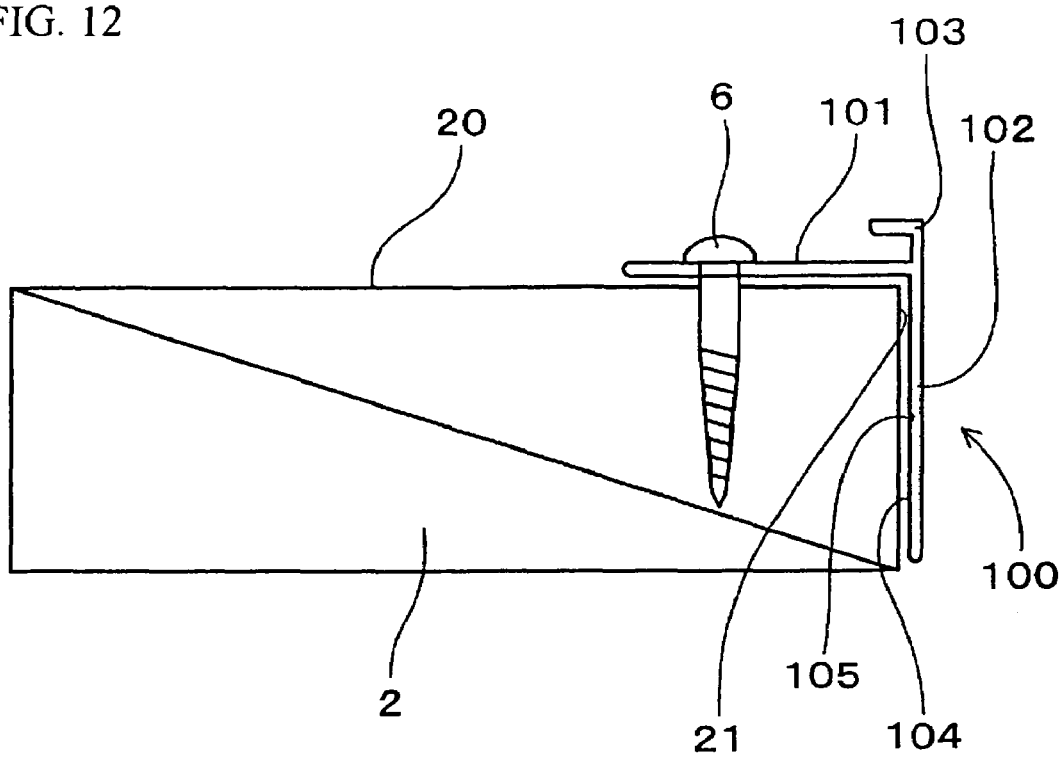
FIG. 12 is a cross-sectional explanatory view showing the positional relationship between the L-joiner and the underlayment member according to the embodiment of the present invention.
Figure 13:
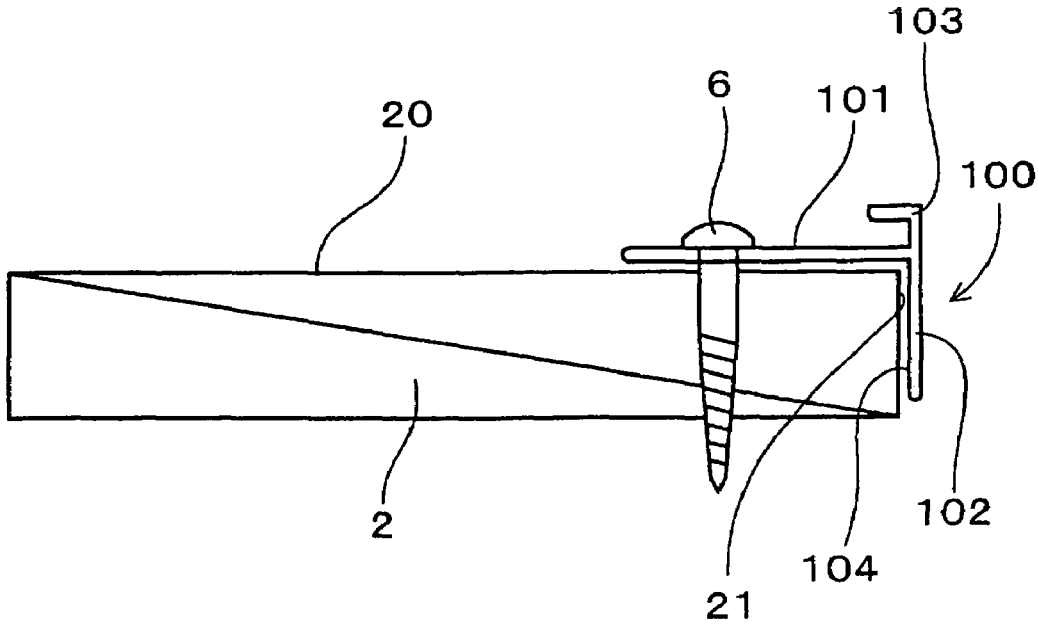
FIG. 13 is a cross-sectional explanatory view showing the positional relationship between the L-joiner and the underlayment member in a case in which the underlayment member is small in thickness.
Figure 14:
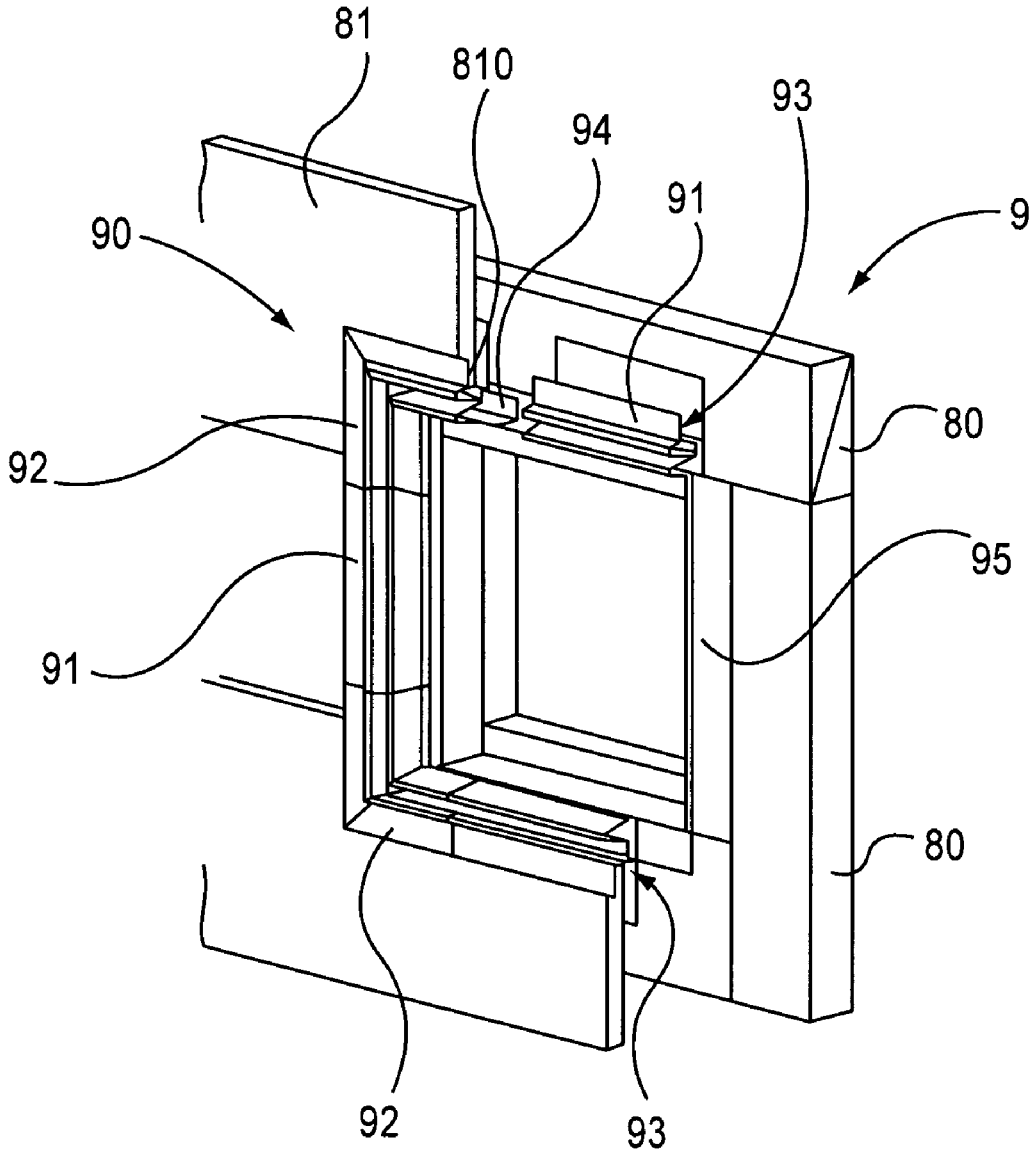
FIG.14 PRIOR ART
FIG. 14 is an explanatory perspective view showing a conventional opening portion periphery construction structure.

As shown in FIG. 12, on the rear side surface 104 of the inner side plate portion 102 of the L-joiner 100, a rib notch 105 for adjusting the length of the inner side plate portion 102 in accordance with the thickness of the underlayment member 2 is formed. That is, as shown in FIGS. 12-13, this rib notch 105 is formed so that the inner side plate portion 102 can be easily cut or broken along the rib notch 105 when the underlayment member 2 is thin.

As shown in FIGS. 1, 10, and 11, sealing material 4 is cast between the end portion 30 of the external wall panel 3 and the outward face portion 111 of the frame member 11. That is, the backup material 40 is disposed in such a manner that the backup member 40 is in contact with the end portion 30 of the external wall panel 3, the outward face portion 111 of the frame member 11 and the fixing plate portion 114, and the sealing material 4 is cast in front of the backup member 40. In order to secure further enhanced waterproofness, as shown in FIG. 1, sealing material 400 can be cast at the butted portion of the L-joiner 100.

The opening portion periphery construction structure 1 can be constructed by performing an L-joiner fixing step, a frame member attaching step, an external wall panel attaching step, and a sealing material casting step, which will be mentioned later.

Figure 2:
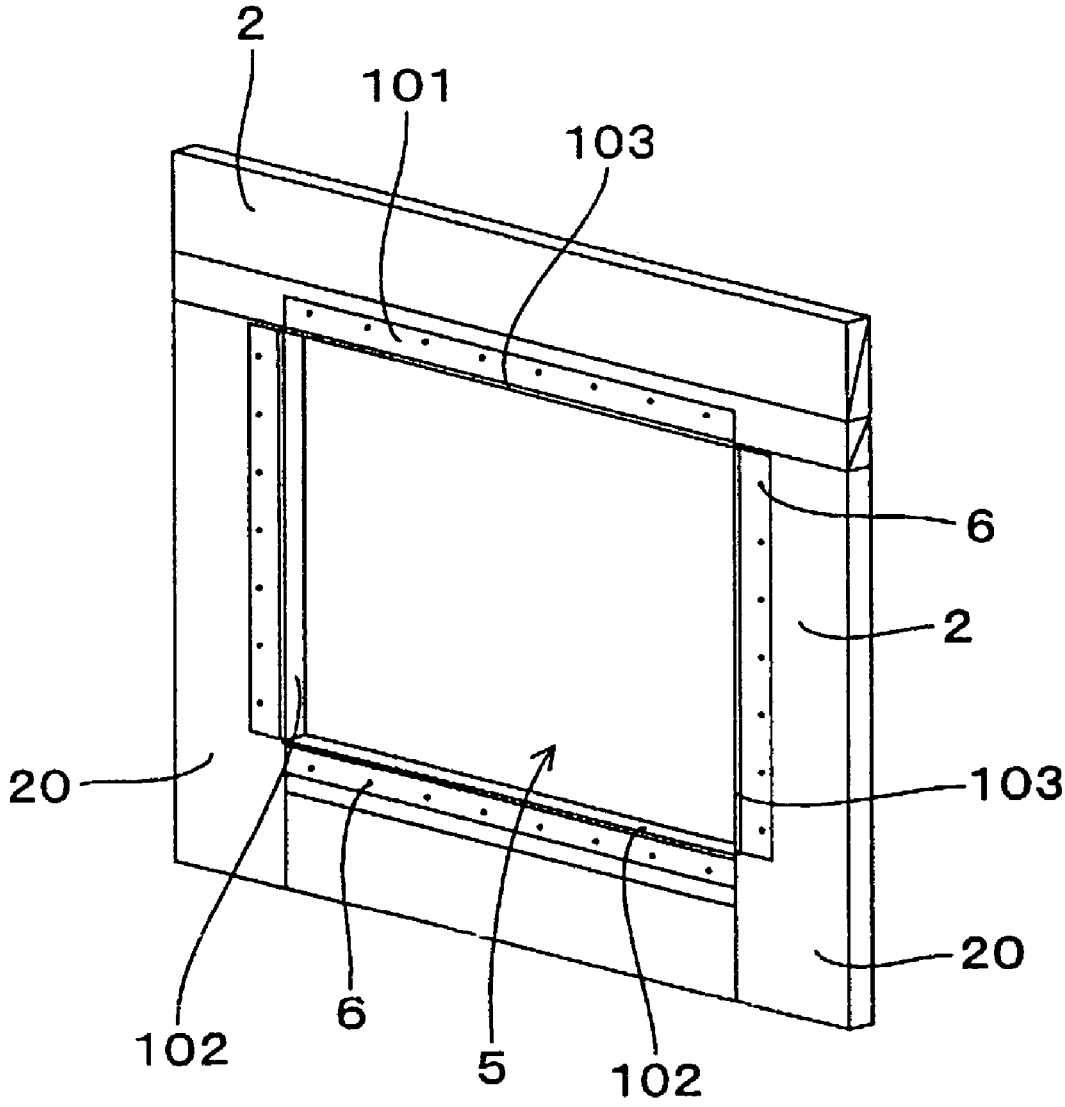
FIG. 2 is an explanatory perspective view showing the state in which L-joiners are fixed to the underlayment member.

At the L-joiner fixing step, as shown in FIGS. 2 and 12, the front plate portion 101 of the L-joiner 100 is fixed to the front face 20 of the underlayment member 2 with screws 6, and the inner side plate portion 102 is placed on the inner side surface 21 of the underlayment member 2.

At the frame member attaching step, as shown in FIGS. 1, 10 and 11, the frame member 11 is installed in a state in which the frame side engaging portion 115 is engaged with the joiner side engaging portion 103, the fixing plate portion 114 is fixed to the underlayment member 2 with nails 7, and the decorative portion 113 decorates the periphery of the opening portion 5.

At the external wall panel attaching step, the end portion 30 of the external wall panel 3 is disposed so as to face to the outward face portion 111 and fixed to the underlayment member 2 with nails 7.

At the sealing material casting step, sealing material 4 is cast between the end portion 30 of the external wall panel 3 and the frame member 11.

Although FIGS. 5 and 10 basically show the left side frame member 11*c*, the right side frame member 11*d* is the same as this left side frame member 11*c*. That is, the left side frame member 11*c* can be used as a right side frame member 11*d* by reversing it from the state shown in FIGS. 5 and 10. In FIG. 11, the reference numeral 310 denotes a column constituting a structure building frame of an existing building, and the reference numeral 320 denotes a sash (window frame) arranged on the opening portion 5 of the existing building.

Now, the functions and effects of the embodiment will be explained.

The opening portion periphery decorative member 10 is mainly constituted by the L-joiners 100 and the frame members 11*a,b,c*, and *d*. Therefore, the number of parts constituting the opening portion periphery decorative member 10 can be decreased, which makes it possible to easily construct the opening portion periphery construction structure 1 at low cost.

The L-joiner 100 is installed such that the front plate portion 101 is fixed to the front face 20 of the underlayment member 2 and the inner side plate portion 102 is placed on the inner side surface 21 of the underlayment member 2. Thus, the underlayment member 2 installed as a underlayment of the external wall panel 3 can be concealed, resulting in an opening portion periphery construction structure 1 excellent in external appearance.

Furthermore, since the frame member 11 is fixed to the underlayment member 2 in a state in which the frame side engaging portion 115 is engaged with the joiner side engaging portion 103 and the fixing plate portion 114 is in contact with the underlayment member 2, the frame member 11 can be stably fixed to the underlayment member 2. That is, in fixing the frame member 11 to the underlayment member 2, the fixing plate portion 114 is fixed with nails 7 with the frame member 11 engaged with the L-joiner 100. Therefore, it becomes possible to prevent occurrence of a clearance at the opening portion side between the frame member 11 and the L-joiner 100. Thus, an opening portion periphery construction structure 1 excellent in external appearance and weather resistance can be obtained.

The frame member 11 has the outward face portion 111, and the end portion 30 of the external wall panel 3 is placed so as to face to the outward face portion 111. Therefore, it is not required to engage the end portion 30 of the external wall panel 3 with the frame member 11, which in turn can easily and assuredly perform the construction of the opening portion periphery construction structure 1. Furthermore, the external wall panel 3 used for the opening portion periphery construction structure 1 is not required to have a specific thickness.

At the sealing material casting step, sealing material 4 is cast between the end portion 30 of the external wall panel 3 and the frame member 11. Therefore, the opening portion periphery construction structure 1 excellent in waterproofness can be obtained. Moreover, even if the external wall panel 3 is cut at a construction site, the end portion 30 of the external wall panel 3, which is a cut surface, will not be exposed to the outside, causing no drawback, such as, e.g., corrosion, which in turn can obtain an opening portion periphery construction structure 1 excellent in weather resistance.

Since the frame member 11 has the hollow portion 116, a frame member 11 excellent in decorativeness can be obtained, and weight saving can be attained. As a result, a frame member 11 excellent in external appearance can be obtained easily at low cost.

The frame member 11 is provided with cap members 118 closing the end portions of the hollow portion 116, which prevents intrusion of water, such as, e.g., rain water, into the hollow portion 116 and conceals the cut surface of the frame member 11 even if the end portion of the frame member 11 is cut. Thus, an opening portion periphery decorative member 10 and an opening portion construction structure 1 excellent in external appearance and weather resistance can be obtained.

Furthermore, the inward face portion 112 of the lower side frame member 11*b* is inclined outwardly toward the front side, i.e., downward toward the front side. Thus, raindrops fall onto the inward face portion 112 of the lower side frame member 11*b* can be discharged frontward, to thereby prevent accumulation of rain water. Moreover, the inward face portion 112 of the upper side frame member 11*a* and the inward face portion 112 of the lower side frame member 11*b* have the same inclination angle. Therefore, the same cap members 118*c* and 118*d* can be used by disposing upside down. This enables decreasing of the number of types of parts constituting the opening portion periphery decorative member 10, resulting in an opening portion periphery construction structure 1 easy in construction and low in cost.

The upper side frame member 11*a* and the lower side frame member 11*b* each have a protruded plate portion 117. This protruded plate portion 117 functions as a water draining member, resulting in enhanced drainage. Moreover, since the frame member 11 is an aluminum extruded molded article rich in formability, an opening portion periphery decorative member 10 and the opening portion periphery construction structure 1 excellent in decorativeness can be obtained.

The gap portion 140 is formed between the front plate portion 101 of the L-joiner 100 and a frame member 11. Thus, the heads of screws 6 can be disposed in the gap portion 140, which prevents such a drawback that the heads of screws 6 become obstructive and the frame member 11 is lifted by the thickness of the head of the screw 6.

As mentioned above, according to the embodiment, it is possible to provide an opening portion periphery decorative member, an opening portion periphery construction structure, and an opening portion periphery construction method easy in construction, and excellent in external appearance and weather resistance can be offered.

For example, the upper, lower, left and right frame members 11 can be installed on the opening portion 5 in a state in which the cap members 118*a* and 118*b* attached to the ends of upper side frame member 11*a* and the lower side frame member 11*b* are in contact with the inward face portions 112 of the left side frame member 11*c* and the right side frame member 11*d*. Although the opening portion periphery construction structure 1 of this embodiment is for remodeling, it can also be applied to a new building.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as a non-specific, general reference and may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

What is claimed is:

1. An opening portion periphery decorative member to be installed on a periphery of an opening portion of a building, the decorative member comprising:

upper, lower, left and right L-joiners each to be fixed to an underlayment member installed as an underlayment of an external wall panel along upper, lower, left and right sides of the opening portion; and upper, lower, left and right frame members each configured to be engaged with the upper, lower, left and right L-joiners, respectively, and fixed to a front face of the underlayment member, wherein the L-joiners each have a front plate portion to be fixed to a front face of the underlayment member, an inner side plate portion extended rearward from one end of the front plate portion so as to be placed on an inner side surface of the underlayment member, and a joiner side engaging portion protruded frontward from the one end of the front plate portion, and wherein the frame members each have an outward face portion to be disposed so as to face to an end portion of the external wall panel, an inward face portion to be disposed so as to face to the opening portion, a decorative portion which decorates the periphery of the opening portion and connects a front end of the outward face portion and a front end of the inward face portion, a frame side engaging portion configured to be engaged with the joiner side engaging portion at a rear end portion of the inward face portion, and a fixing plate portion extended from a rear end of the outward face portion in a direction away from the frame side engaging portion and configured to be fixed to the underlayment member wherein a gap portion is formed between the front plate portion of the L-joiner and the frame member in a state in which the L-joiner and the frame member are combined.

2. The opening portion periphery decorative member as recited in claim 1, wherein the frame members each have a hollow portion extending in a longitudinal direction thereof, and wherein the decorative portion, the inward face portion and the outward face portion form a part of the hollow portion.

3. The opening portion periphery decorative member as recited in claim 2, wherein the frame members each are provided with cap members for closing both ends of the hollow portion.

4. The opening portion periphery decorative member as recited in claim 3, wherein the frame members each include an upper side frame member and a lower side frame member to be disposed at an upper side of the opening portion and a lower side thereof, respectively, wherein the inward face portion of the upper side frame member and the inward face portion of the lower side frame member each are inclined outwardly toward a front side, wherein the inward face portion of the upper side frame member and the inward face portion of the lower side frame member have the same inclination angle, and wherein an external end surface of the cap member is inclined along the inward face portion.

5. The opening portion periphery decorative member as recited in claim 1, wherein the frame members each include an upper side frame member and a lower side frame member to be disposed at an upper side of the opening portion and a lower side thereof, respectively, and wherein the upper side frame member and the lower side frame member each have a protruded plate portion protruded from a lower end of the decorative portion.

6. The opening portion periphery decorative member as recited in claim 1, wherein the frame member is an aluminum extruded molded article.

7. An opening portion periphery construction structure in which an opening portion periphery decorative member is installed on a periphery of an opening portion of a building, the structure comprising:

an underlayment member installed as an underlayment of an external wall panel along upper, lower, left and right sides of the opening portion;

the opening portion periphery decorative member attached to the underlayment member; and the external wall panel having an end portion placed outside the opening portion periphery decorative member so that the end portion faces to the opening portion periphery decorative member, wherein the opening portion periphery decorative member has upper, lower, left and right L-joiners each to be fixed to the underlayment member, upper, lower, left and right frame members each to be fixed to a front face of the underlayment member and configured to be engaged with the corresponding L-joiner, wherein the L-joiners each have a front plate portion, an inner side plate portion extended rearward from one end of the front plate portion, and a joiner side engaging portion protruded frontward from the one end of the front plate portion, wherein the frame members each have an outward face portion, an inward face portion, a decorative portion which connects a front end of the outward face portion and a front end of the inward face portion, a frame side engaging portion formed at a rear end portion of the inward face portion, and a fixing plate portion extended from a rear end of the outward face portion in a direction away from the frame side engaging portion, wherein the front plate portion of the L-joiner is fixed to a front face of the underlayment member, and the inner side plate portion of the L-joiner is placed on an inner side surface of the underlayment member, and wherein the decorative portion is disposed so as to decorate the opening portion in a state in which the frame side engaging portion of the frame member is engaged with the joiner side engaging portion, the fixing plate portion is fixed to the underlayment member, and the outward face portion is faced to the end portion of external wall panel.

8. The opening portion periphery construction structure as recited in claim 7, wherein the frame members each have a hollow portion extending in a longitudinal direction thereof, and wherein the decorative portion, the inward face portion and the outward face portion form a part of the hollow portion.

9. The opening portion periphery construction structure as recited in claim 8, wherein the frame member is provided with cap members for closing both ends of the hollow portion.

10. The opening portion periphery construction structure as recited in claim 9, wherein the frame member includes an upper side frame member and a lower side frame member to be disposed at an upper side of the opening portion and a lower side thereof, respectively, wherein the inward face portion of the upper side frame member and the inward face portion of the lower side frame member are inclined outwardly toward a front side, respectively, wherein the inward face portion of the upper side frame member and the inward face portion of the lower side frame member have the same inclination angle, and wherein an external end surface of the cap member is inclined along the inward face portion and is in a face-contact with the inward face portion.

11. The opening portion periphery construction structure as recited in claim 7, wherein the frame member includes an upper side frame member and a lower side frame member to be disposed at the upper side of the opening portion and the lower side thereof, respectively, and wherein the upper side frame member and the lower side frame member each have a protruded plate portion protruded from a lower end of the decorative portion.

12. The opening portion periphery construction structure as recited in claim 7, wherein the frame member is an aluminum extruded molded article.

13. The opening portion periphery construction structure as recited in claim 7, wherein the opening portion periphery construction structure is for reforming, and the underlayment member is fixed to a front face of an existing wall.

14. The opening portion periphery construction structure as recited in claim 7, wherein a gap portion is formed between the front plate portion of the L-joiner and the frame member.

* * * * *